US007370556B2

(12) United States Patent
Sun

(10) Patent No.: US 7,370,556 B2
(45) Date of Patent: May 13, 2008

(54) CORKSCREW

(75) Inventor: Brian Sun, Hong Kong (HK)

(73) Assignee: Technical Development (HK) Limited, Hong Kong (HK)

( * ) Notice: Subject to any disclaimer, the term of this patent is extended or adjusted under 35 U.S.C. 154(b) by 0 days.

(21) Appl. No.: 10/549,783

(22) PCT Filed: Mar. 19, 2004

(86) PCT No.: PCT/CN2004/000224

§ 371 (c)(1),
(2), (4) Date: Sep. 17, 2005

(87) PCT Pub. No.: WO2004/083101

PCT Pub. Date: Sep. 30, 2004

(65) Prior Publication Data

US 2006/0185477 A1 Aug. 24, 2006

(30) Foreign Application Priority Data

Mar. 19, 2003 (GB) ..... 0306239

(51) Int. Cl.
*B67B 7/04* (2006.01)
*B67B 7/00* (2006.01)

(52) U.S. Cl. ..... 81/3.29; 81/3.27; 81/3.45; 81/3.48; 81/3.37

(58) Field of Classification Search ..... 81/3.29, 81/3.39, 3.36, 3.27, 3.45, 3.48, 3.09
See application file for complete search history.

(56) References Cited

U.S. PATENT DOCUMENTS

| | | | | |
|---|---|---|---|---|
| 5,367,923 | A | 11/1994 | Fabbro | |
| 5,934,160 | A | 8/1999 | Gibson | |
| 7,069,813 | B2 * | 7/2006 | Cheung | 81/3.37 |
| 7,069,825 | B2 * | 7/2006 | Cheung | 81/337 |
| 2002/0174489 | A1 | 11/2002 | Puig | |
| 2003/0126953 | A1 * | 7/2003 | Kushner | 81/3.45 |

FOREIGN PATENT DOCUMENTS

| | | | |
|---|---|---|---|
| DE | 4107567 | A1 | 3/1991 |
| DE | 20219538 | U1 | 12/2002 |
| DE | 20219538 | * | 4/2003 |
| EP | 1215165 | * | 6/2002 |
| FR | 7620848 | | 7/1976 |
| FR | 9003884 | | 3/1990 |
| GB | 2127795 | | 6/1980 |
| GB | 2304703 | | 8/1995 |
| GB | 2399566 | | 3/2003 |
| GB | 0306239.5 | | 9/2003 |
| GB | 0425959.4 | | 5/2005 |
| WO | WO 96/15062 | | 5/1996 |
| WO | WO 01/70620 | | 9/2001 |
| WO | WO 2004/083101 | A1 | 9/2004 |

* cited by examiner

*Primary Examiner*—Joseph J. Hail, III
*Assistant Examiner*—Robert Scruggs
(74) *Attorney, Agent, or Firm*—Daniel B. Schein, Esq.

(57) ABSTRACT

A corkscrew comprising a body and a handle, the body including a socket adapted to receive the neck of a bottle sealed by a cork, an actuation lever, an axially rotatable worm spiral mounted on a carriage within the body and arranged to rotate and penetrate the cork as the lever is lowered, the spiral being further arranged to cease rotation as the lever is raised to withdraw the cork from the bottle, the corkscrew being further arranged to discharge the cork from the screw by lowering and raising the lever after the neck of the bottle has been removed from the socket.

21 Claims, 19 Drawing Sheets

STEP 1

STEP 2

STEP 3

STEP 4

STEP 5

STEP 6

STEP 7

STEP 8

STEP 9

CORKSCREW

This invention relates to a corkscrew which may be used for removing a cork from a bottle, for example a bottle of wine, vegetable oil or other liquid.

There are many designs of corkscrews wherein a sharpened worm screw extends from a handle or lever mechanism. Such corkscrews can be dangerous in use and may require dexterity and manual strength in their operations.

It is an object of the present invention to provide a corkscrew which overcomes these disadvantages.

In this specification references to upward and downward are intended to refer to the corkscrew as used with respect to an upright bottle, that is with the proximal region uppermost and the listed distal in contact with the bottle neck.

According to the present invention there is a provided a corkscrew comprising a body and a handle, the body including a socket adapted to receive the neck of a bottle sealed by a cork, an actuation lever, an axially rotatable worm spiral mounted on a carriage within the body and arranged to rotate and penetrate the cork as the lever is lowered, the spiral being further arranged to cease rotation as the lever is raised to withdraw the cork from the bottle, the corkscrew being further arranged to discharge the cork from the screw by lowering and raising the lever after the neck of the bottle has been removed from the socket;

wherein the carriage is mounted for movement between upper and lower positions along one or more, preferably two, guide runners extending longitudinally of the body, the spiral being connected to the carriage by a bearing, the spiral being rotatable with respect to the bearing, and further comprising a guide member having a guideway spaced from the screw axis the screw extending through the guide member, the guideway being adapted to cause the screw to rotate as the screw moves axially through the guide member, first latch means being adapted to releasably engage the guide member to the corkscrew body, and second latch means being adapted to releasably engage the guide member to the carriage.

In a preferred embodiment of the invention, the spiral is wholly contained within the body and thereby shielded by the body during all stages of use to remove a cork. This reduces the likelihood of injury to a user. The corkscrew of this invention may efficiently remove the cork from a bottle and then release the cork from the spiral without use of excessive force or any need for dexterity by a user. The corkscrew is therefore easy and quick to use. Use by elderly, infirm or disabled persons is facilitated.

The guideway may have a helical threaded bore adapted to receive the helical screw, permitting the screw to rotate as the guide member moves axially relative to the screw.

The first latch means may be actuated by insertion of the neck of a bottle into the socket.

When the first latch means is engaged, the guide member and carriage may move together so that the spiral screw may be raised by the actuation lever without rotation of the screw, allowing a cork to be withdrawn from a bottle.

When the opened bottle is removed from the socket, the first latch is urged by a spring to move to an armed position, in which position the guide member is engaged and prevented from further movement when it reaches the lower position.

The second latch means is preferably actuated by the first latch means. When the first latch is in the armed position, the second latch is opened releasing the carriage for movement independently of the guide member. In this state, the spiral screw is turned by passage through the guideway as the carriage is raised and lowered by the actuation lever.

When there is no bottle in the socket or when the bottle has been removed from the socket, the first latch member may cause the second latch to move to an open position, wherein the carriage may move freely with respect to the guide member.

When a bottle neck is inserted into the socket, the second latch may be urged into an armed position wherein the carriage is engaged as it moves to the lower position preventing independent movement of the carriage relative to the guide member.

The first latch preferably comprises one or more, preferably two elongate members secured to the interior of the socket and biassed inwardly towards the guide member. The first latch may include a hook with a downwardly facing restraining surface, arranged to engage an upwardly facing surface of the guide member to restrain upward movement of the latter.

The first latch preferably extends from an attachment to the corkscrew body and includes a downwardly facing restraining surface located to contact and engage a complementary upwardly extending abutment surface of the guide member.

In a preferred embodiment the first latch member has a radially inwardly facing formation which provides a bottle engaging surface adapted to engage the top of the neck of a bottle as it is inserted into the socket causing the first latch to move outwardly. Preferably the first latch is pivoted at or adjacent a lower end thereof, being biassed inwardly by a spring. A plurality, preferably two latches may be used, arranged symmetrically preferably on opposite sides of the socket to engage the sides of the bottle neck, preferably on opposite sides of the neck.

In a preferred embodiment the guide member is located on the runners between the carriage and the socket. In this case the screw extends from the carriage through the guide member and downwardly towards the socket.

The second latch member may be elongate in the longitudinal direction and may be mounted on a pivot on the guide member, the upper end being urged inwardly by a spring. A lower portion of the second latch member may include a surface adapted to engage and cooperate with a complementary surface of the first latch member. Preferably the surface of the first latch member is inclined outwardly in the upward direction and the surface of second latch member is inclined inwardly in the lower direction, the two surfaces engaging as the carriage moves into contact with the guide member.

The second latch member may comprise a plate having an aperture adapted to receive and engage a projection or lug extending outwardly from the carriage.

In a preferred embodiment the upper end of the socket comprises an annular ring having a circular groove or other formation dimensioned to receive and engage the neck of a bottle, the annulus defining a cork receiving passageway having a diameter greater than a cork and a length sufficient to allow complete withdrawal of a cork into the passageway as the screw and cork are drawn from the bottle.

A preferred embodiment of the invention includes gripping means adapted to move inwardly when grasped by a user to engage and prevent movement of the neck of a bottle received in the socket.

The gripping means may comprise a pair of arms pivotally mounted on the body and carrying bottle engaging pads adapted to engage and clamp the corkscrew to the bottle. The gripper means may comprise a plurality of arms on the exterior of the body, the bottle engaging pads extending inwardly through apertures in the body. Each arm may be secured by a pivot through an upper part of the body, being biassed outwardly from the body by a spring. The pads are mainly composed of rubber or other resilient or high friction material.

The invention is described by means of example but not in any limitative sense, with reference to the accompanying drawings of which FIG. 1*a* is partially cut away perspective view of a corkscrew in accordance with the invention, FIG. 1*b* is a cross-section of the corkscrew shown in FIG. 1.

Figure 4A:
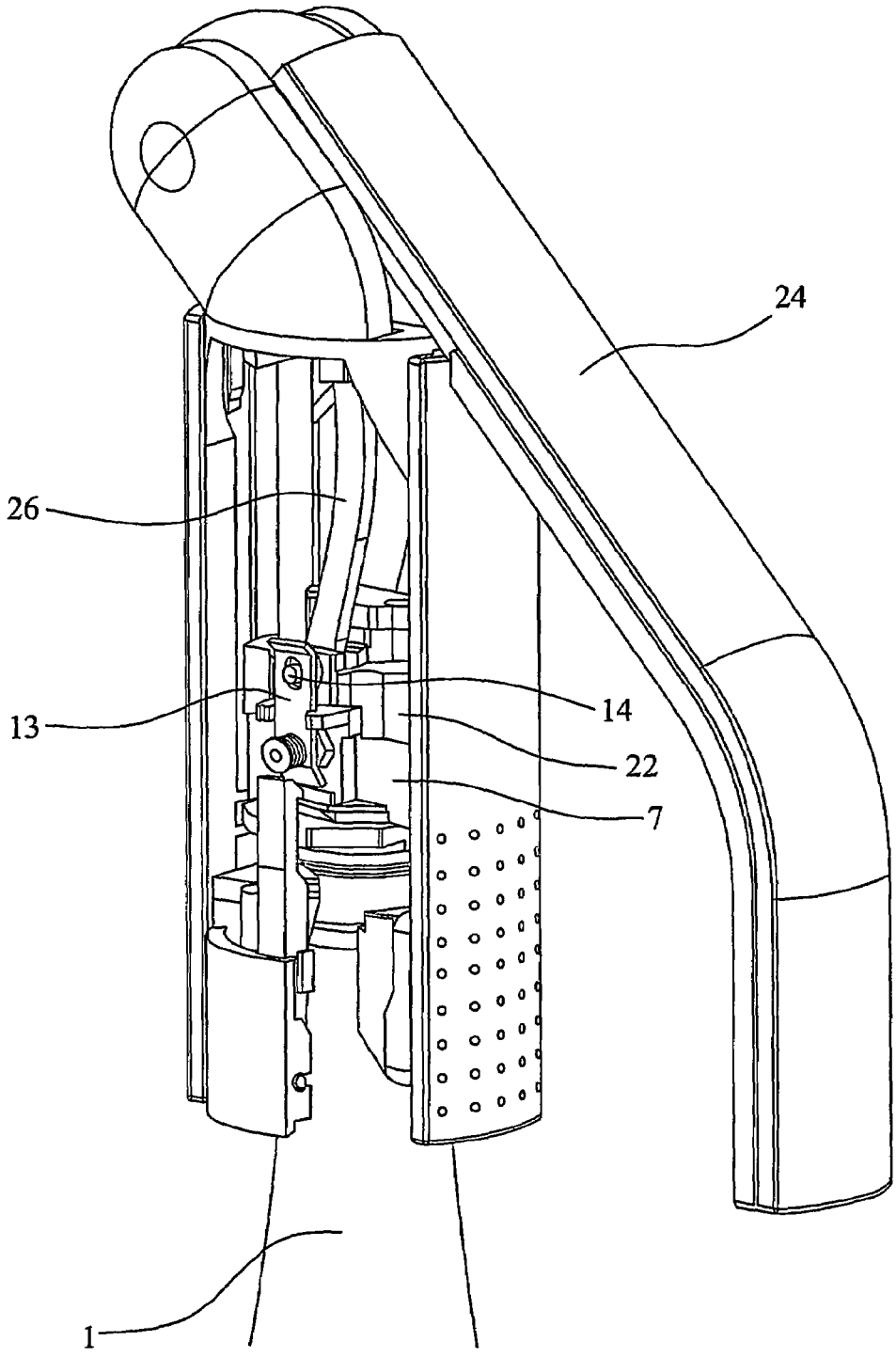

FIG. 4*a* is a partially cut away view of the corkscrew in the fourth step of use.

Figure 4B:
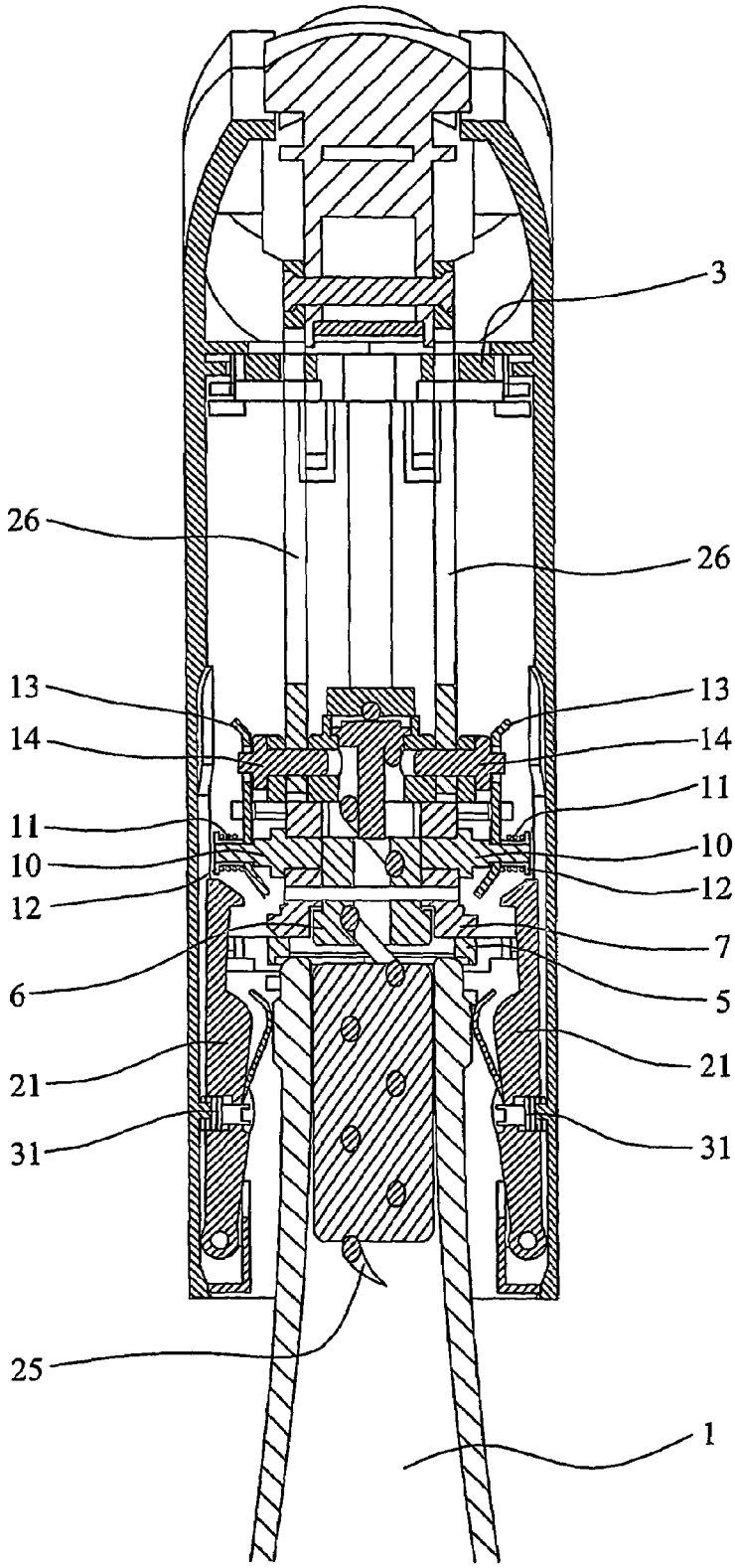

FIG. 4*b* is a cross-sectional view of the corkscrew shown in FIG. 4*a*.

Figure 5:
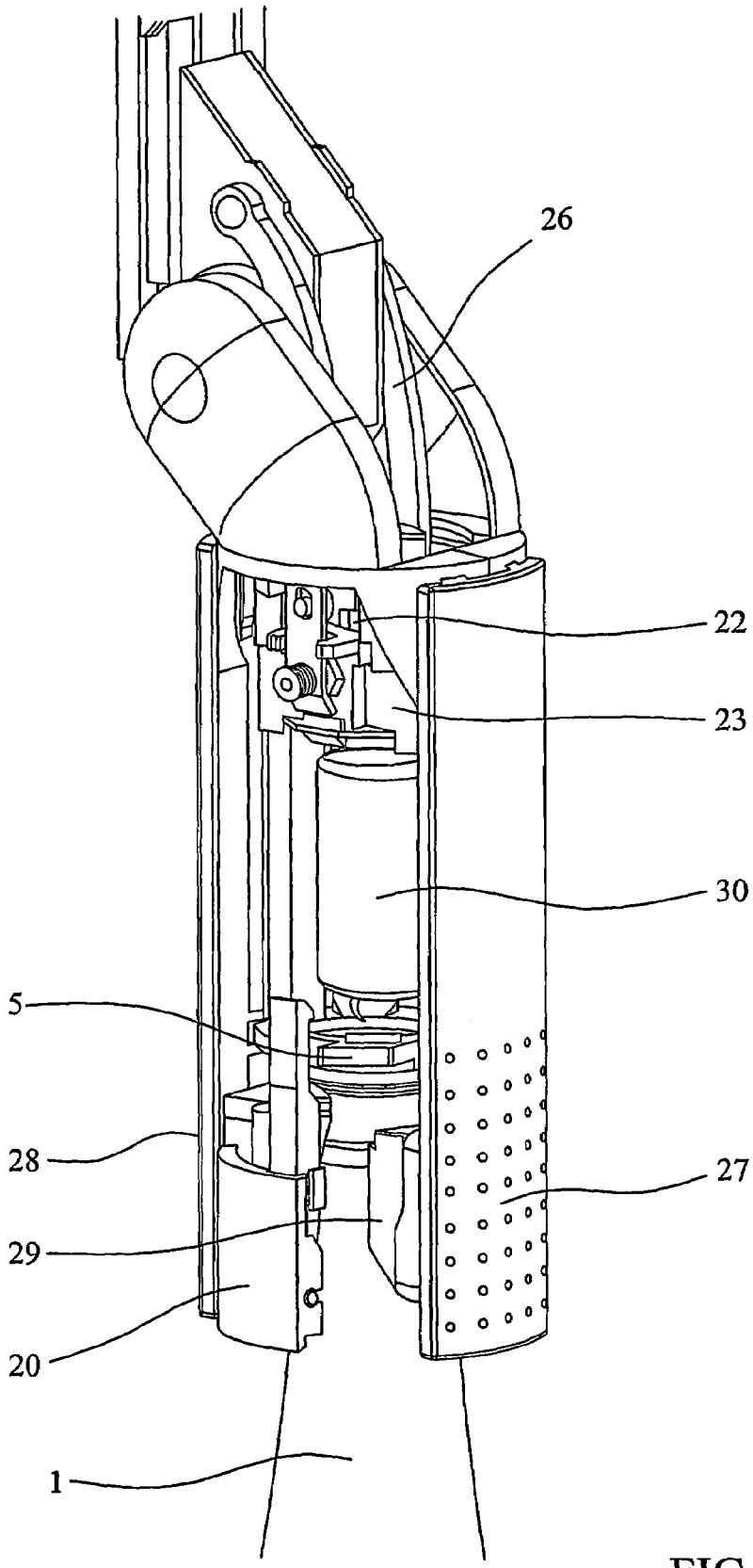

FIG. 5 is a partially cut away view illustrating the corkscrew in the fifth step of use.

Figure 6:
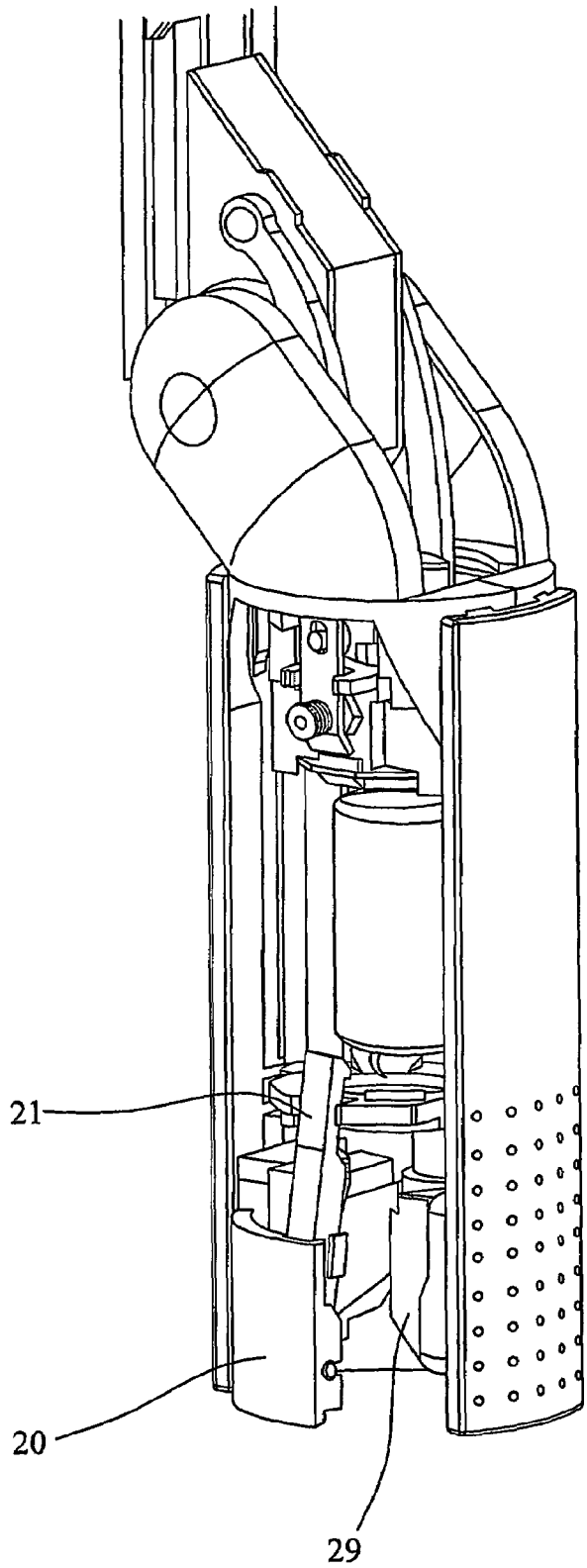

FIG. 6 is a partially cut away view of the corkscrew in the sixth step of use.

Figure 7:
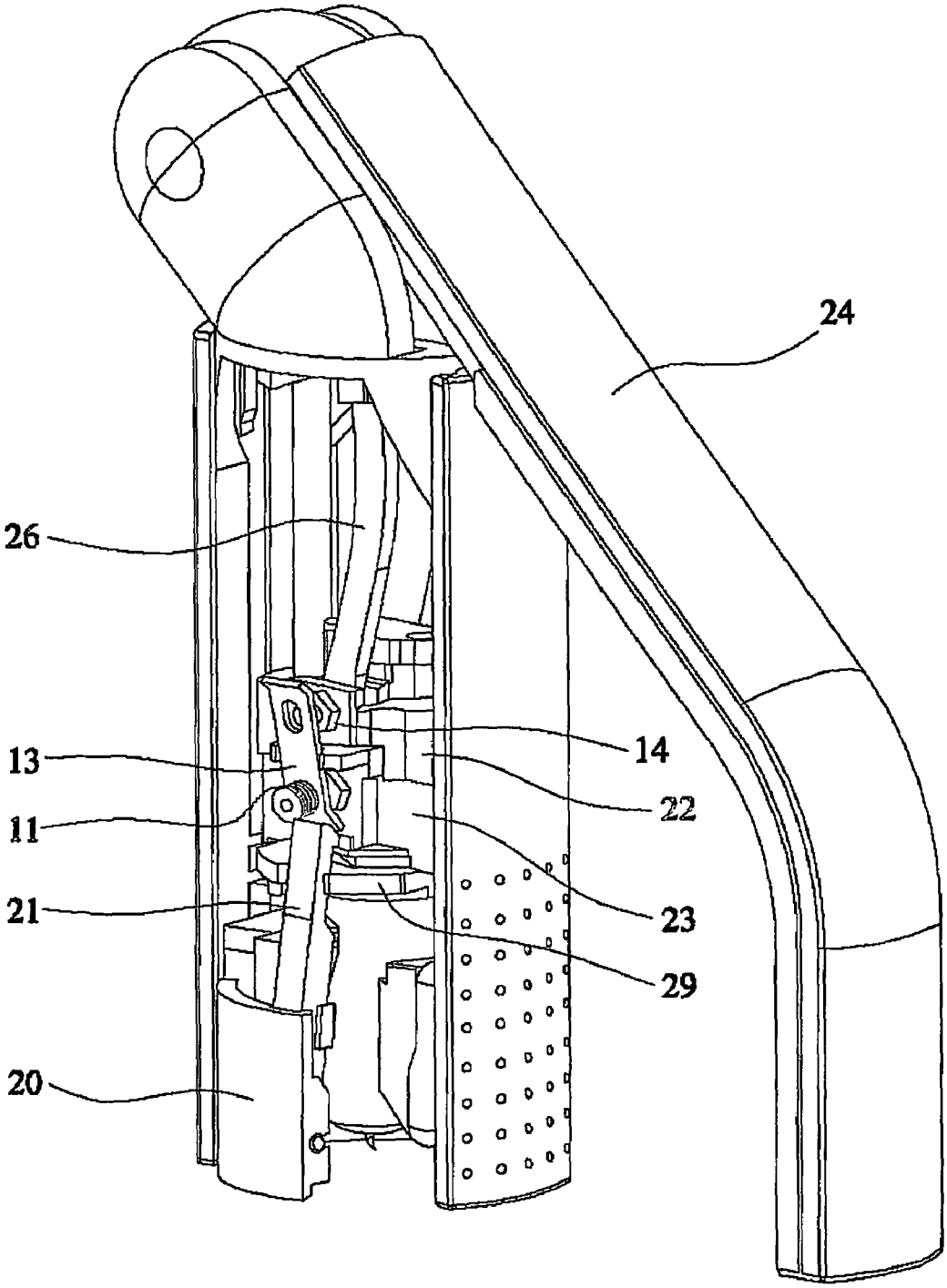

FIG. 7 is a partially cut away view of the corkscrew during the seventh step of use.

Figure 8:
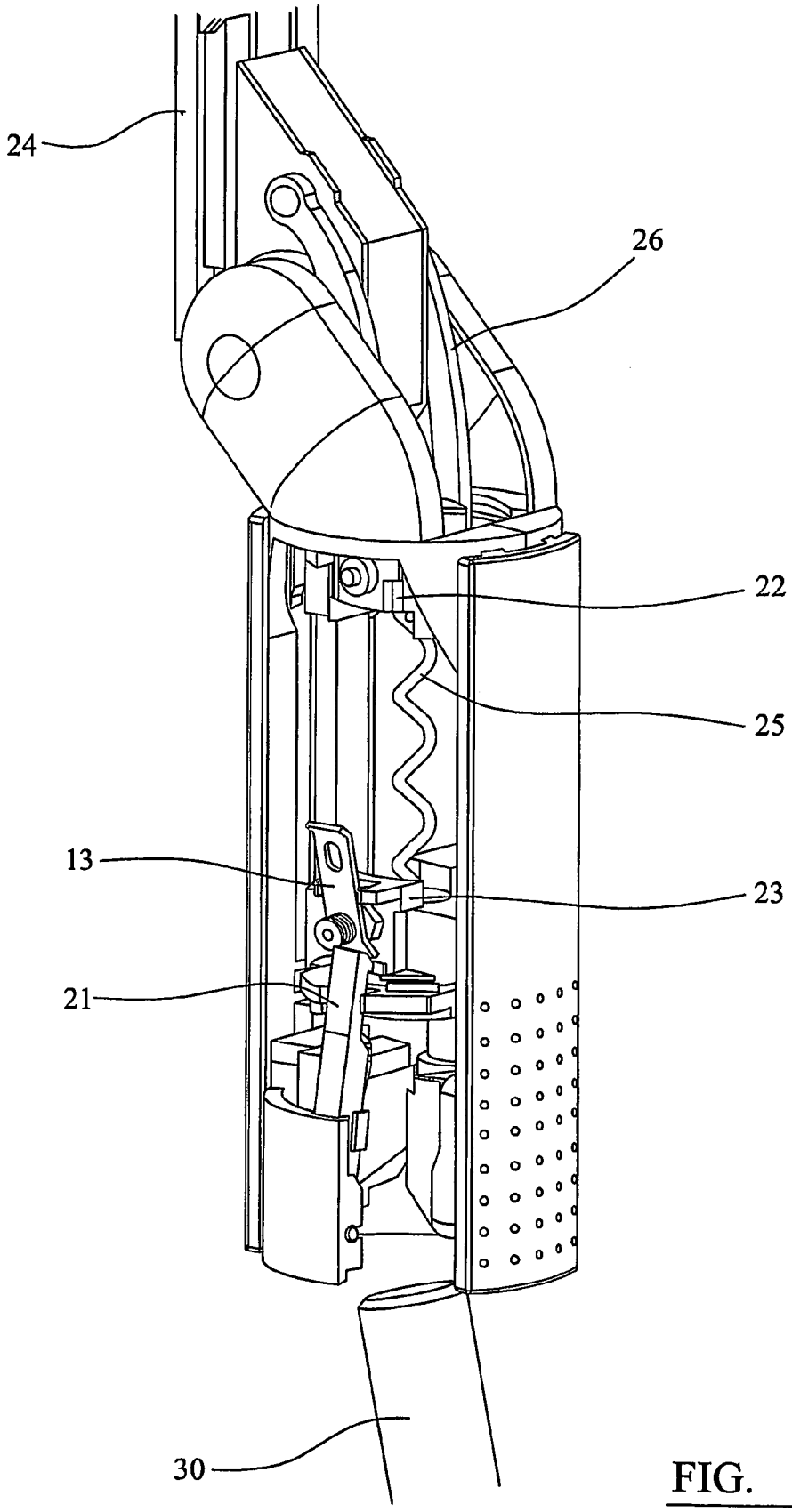

FIG. 8 is a partially cut away view illustrating the corkscrew in the eighth step of use; and FIGS. 9A to I illustrate successive steps in use of the corkscrew.

In the following drawings the same reference numerals are used to denote the same components in each of the Figures.

The corkscrew shown in the Figures comprises a generally cylindrical body 20 having a downwardly facing opening defining a socket 2 to receive the neck of a bottle 1. A handle 24 is mounted on a transverse pivot at the top of the body. A pair of bow shaped arms 26 pivotally attached to the handle, extend downwardly through guide slots in the platform 3.

The lower ends of the arms 26 are pivotally connected by pins 14 to a carriage 22. The carriage 22 is mounted for sliding movement between upper and lower positions on two longitudinal runners 4. The two runners 4 extend from the upper platform 3 to a lower annular ring 5. A sharpened spiral worm screw 25 extends axially from a freely rotatable bearing 6. The spiral 25 is coated with a low friction polymer, for example, polytetrafluoroethylene in a conventional manner to facilitate insertion into the cork and removal.

Lifting of lever 24 raises the carriage 22 and spiral screw 25. Screw 25 extends through a helical threaded bore in a guideway 23 in guide member 7. The guide member 7 is slidably mounted on the runners 4. As the carriage 22 moves relative to the guide member, the motion of the screw 25 through guideway 23 causes the screw to rotate in the clockwise or anticlockwise direction. A first latch mechanism comprises a pair of elongate first latch members 21, pivotally attached at the lower end to a lower distal portion of the body 20 by pins 8 adjacent the mouth of the socket 2. Springs 31 urge the upper ends of members 21 inwardly. Each latch member 21 has an inwardly facing resilient member 9 for example a spring leaf located to engage the neck of a bottle as it is inserted into the socket 2, so that the bottle pushes each of the latch members outwardly against the force of the springs 31.

Figure 1A:
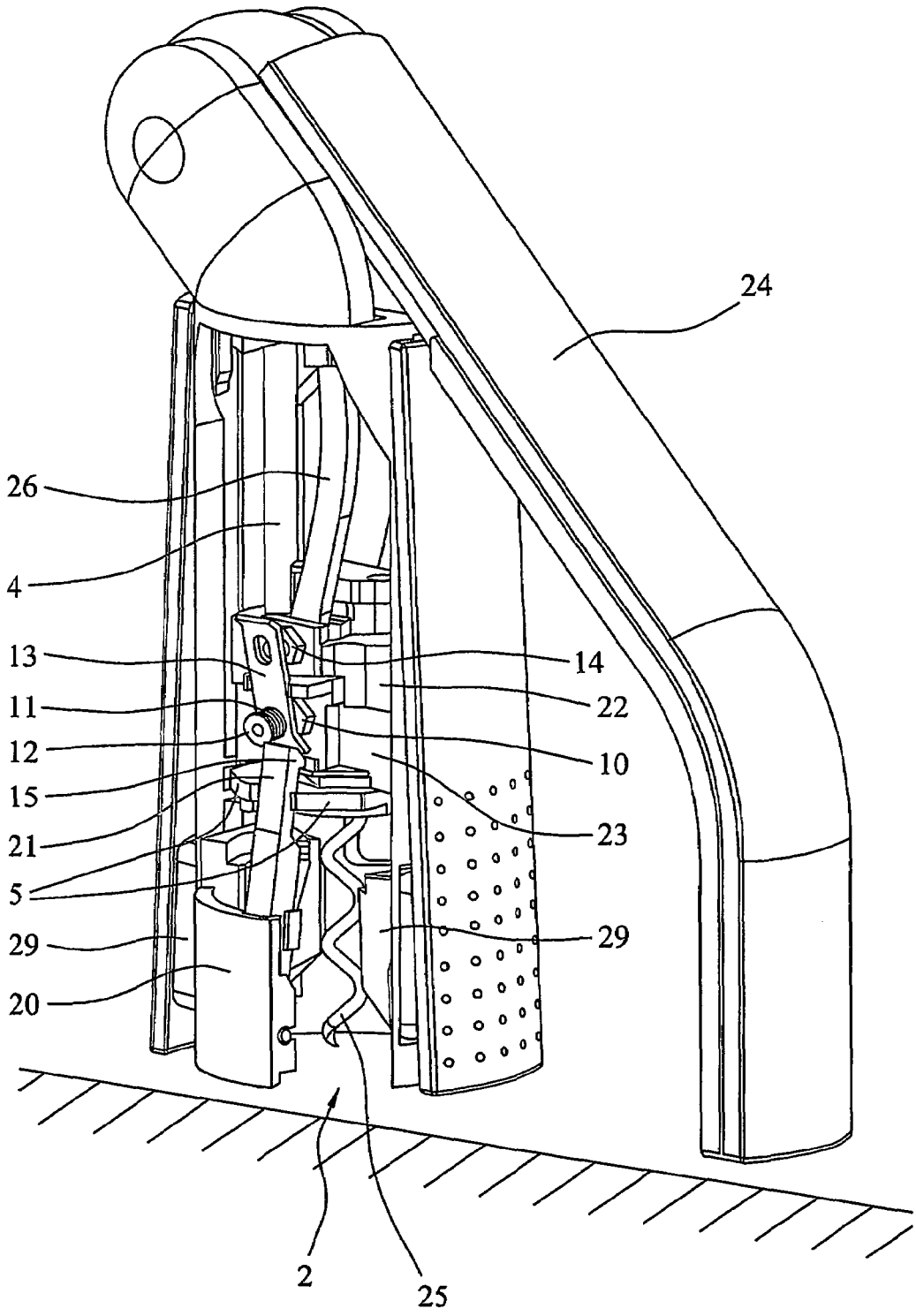
Figure 1B:
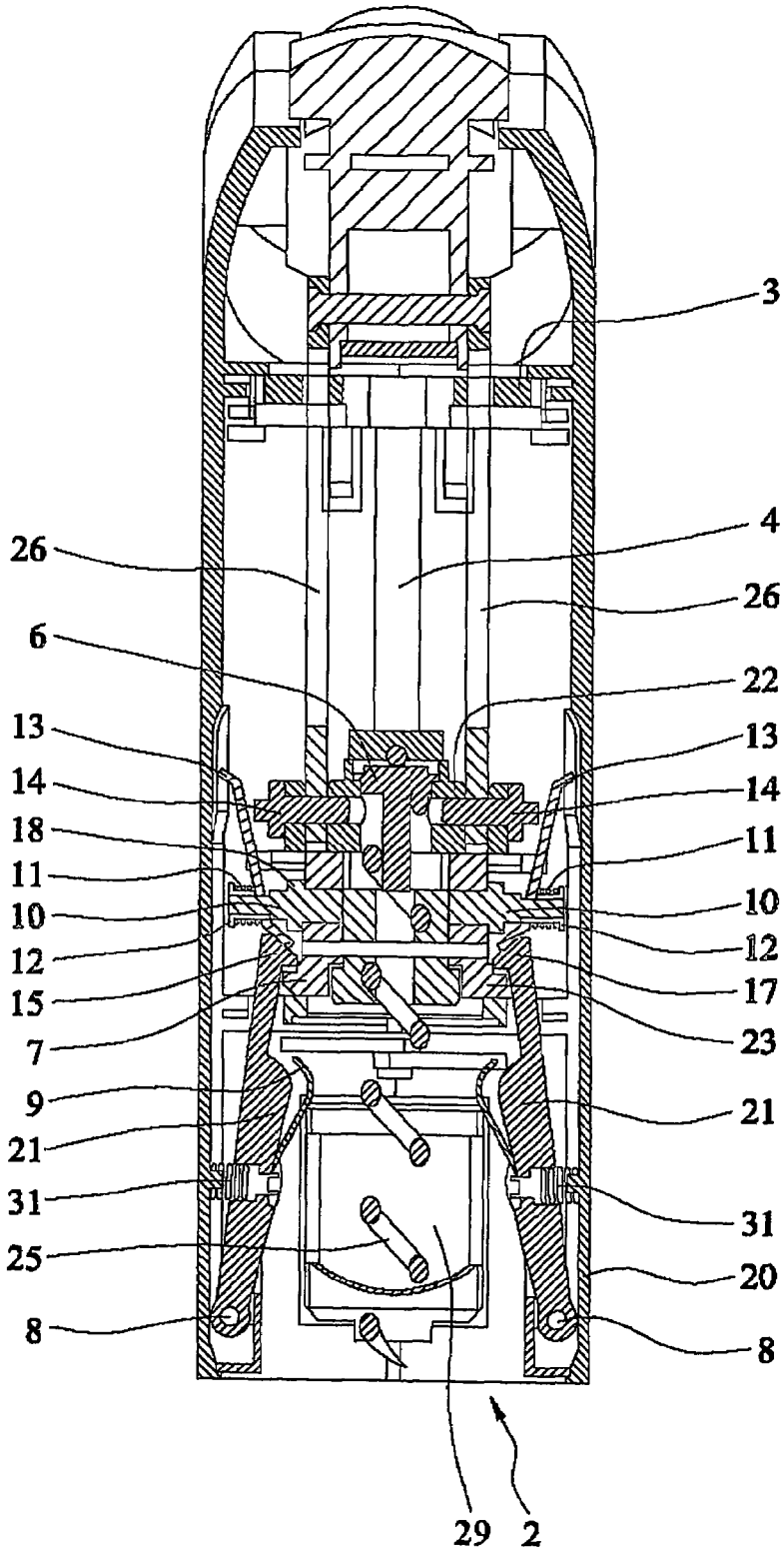

The upper ends of latch members 21 have hooks 15 or other downwardly facing formations, each of which includes a downwardly facing surface located to engage a complementary upwardly facing surface of a flange on the guide member 7. The guide member is therefore secured at its lower position on the runners and is prevented from upward movement along the runners 4, as shown in FIGS. 1*a*, 1*b* and 1*c*.

A pair of pins 10 each extend radially from a carriage 22. Each has an enlargement or shoulder 18 on the shank to provide a fulcrum on which the second member may pivot. The pin 10 also has an enlargement or boss 12 at the end thereof to retain the captive spring 11. Each pin 10 extends through an aperture in the second latch member 13, the member 13 being urged inwardly by the spring 11.

The second latch member is elongate, extending from a lower flange portion 16 (shown in FIG. 1*c*) to an upper portion providing an aperture to receive the end of pin 14. The lower flange 16 extends inwardly in a downward direction. The upper surface of the first latch member 21 is inclined outwardly in the upward direction. The lower flange 16 and upper surface 17 cooperate so that the second latch 13 is engaged as the carriage 32 is moved into contact with the guide member. As the lower end 22 is moved inwardly, the upper end of the second latch 13 is displaced outwardly by the fulcrum 18, releasing the pin 14. This allows the carriage 22 to be moved freely up the runners 4 by raising the handle 24.

Insertion of a bottle into the chamber 2 urges the first latch members outwardly releasing the second latch members so that the upper ends thereof return to an armed state in which the carriage is captured as it is moved downwardly into the lower position by depressing handle 24.

A pair of curved or cylindrical handgrips 27, 28 are pivotally secured to opposite sides of the upper portion of the body 20 and are biassed outwardly away from the body by springs or other resilient means. Bottle engaging pads 29 extend through apertures in the wall of the body into the socket 2. The pads may be formed of rubber or other resilient high friction material and are shaped with cylindrical surfaces to engage the neck of the bottle, preventing removal or rotation of the bottle as the cork is pierced and drawn. The exterior of the grips is roughened to allow a secure grip during use.

The corkscrew of the present invention may have the advantage that it can be manufactured and assembled without use of screws, using interlocking parts held together within the casing of the outer body.

The function of the corkscrew of the present invention may be as follows:

FIGS. 1*a* and 1*b* shown the corkscrew in the normal state before use with the lever 24 lowered. In this state, the shaped end of spiral or screw 25 is located within the lower skirt of the cylindrical body 20. The risk of accidental injury to a user or damage to a work surface is reduced in comparison to conventional corkscrews wherein the sharpened screw is exposed.

In this position, the first latches 21 are urged inwardly by springs 31 so that the hooks 15 on the upper ends engage the upwardly facing flanges of guide member 5, preventing the guide member from moving upwardly along runners 4.

Figure 2:
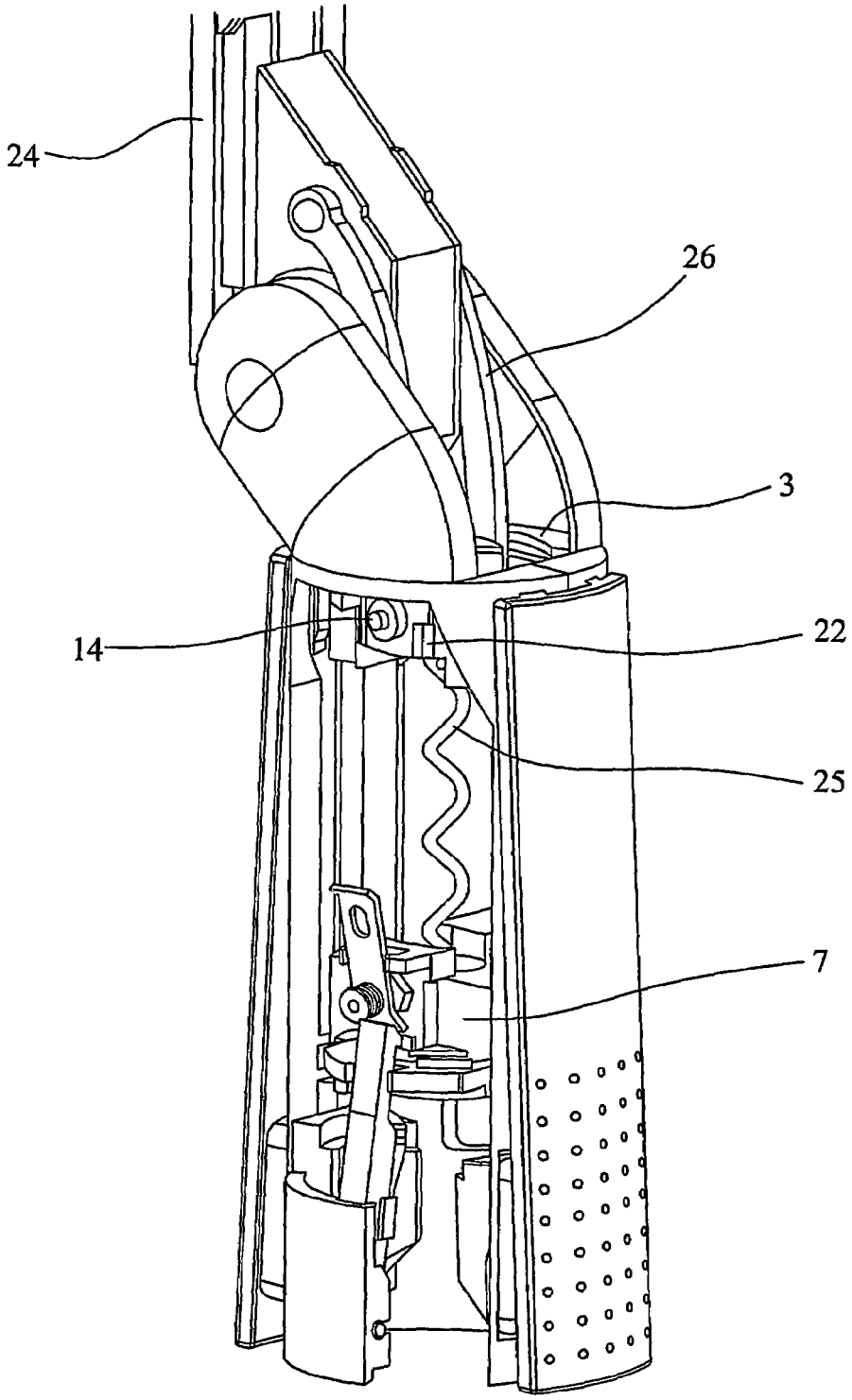
FIG. 2 is a partially cut away view of the second step of use of the corkscrew.
Figure 9A:
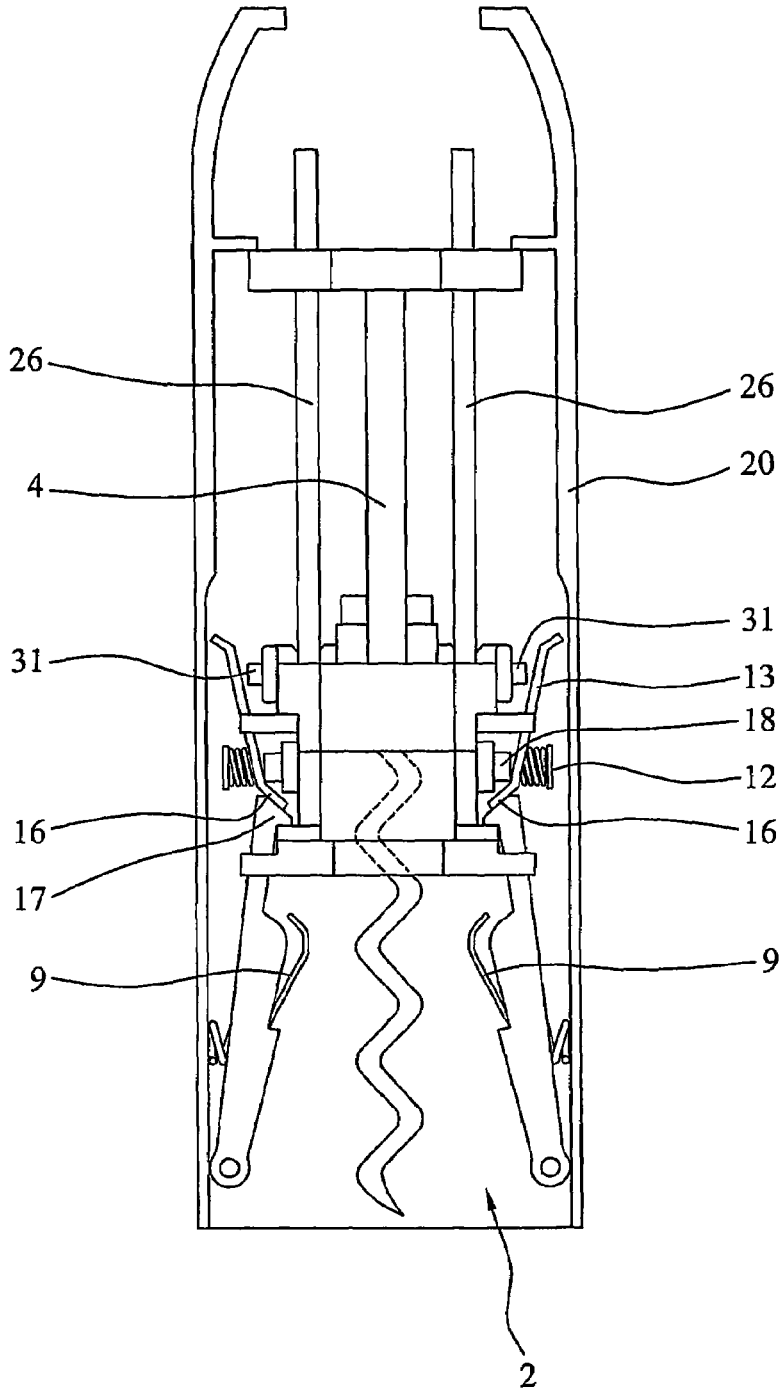
Figure 9B:
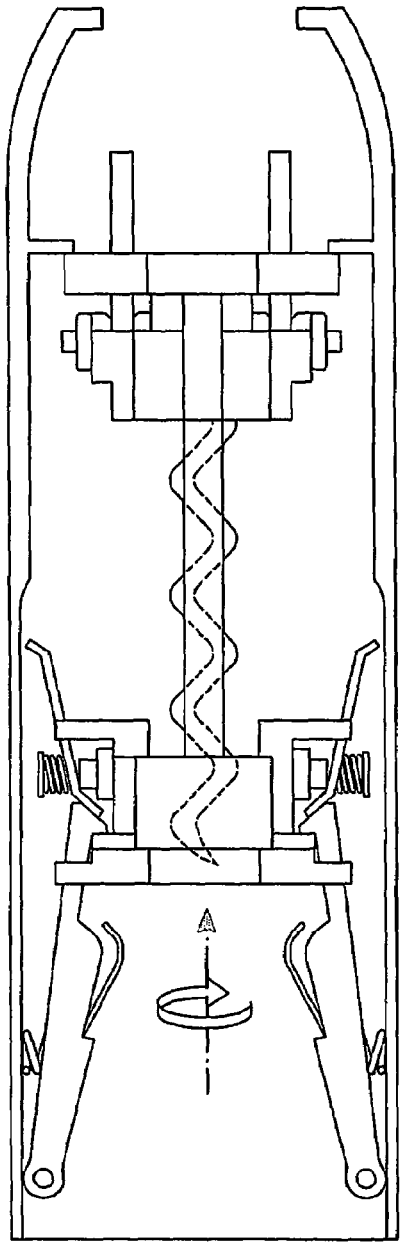

As shown in FIG. 9*a*, the lower ends of the second latches are depressed inwardly by complementary surfaces 17 on the first latches. Pivoting of the second latch members about the fulcrum provided by the shoulders 18 of pins 10 moves the upper ends 13 out of engagement with the studs 31 and the ends of pins 14. The carriage 22, bearing 6 and screw 25 are free to be raised by lifting the handle 24. Passage of the spiral screw 25 through the guide 23 causes the screw to rotate as it is raised to the position shown in FIGS. 2 and 9*b*.

Figure 3:
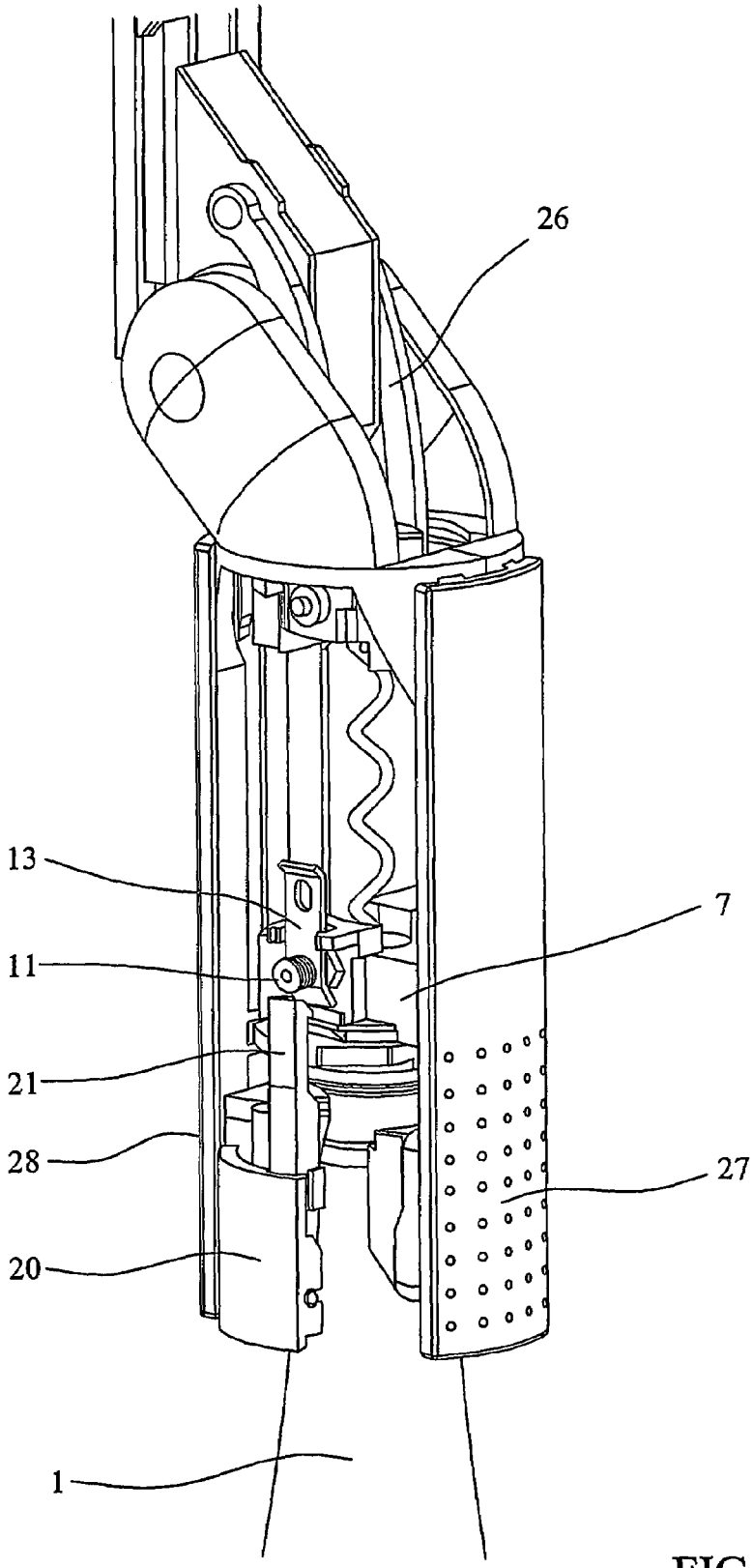
FIG. 3 is a partially cut away view illustrating the third step of use of the corkscrew.
Figure 9C:
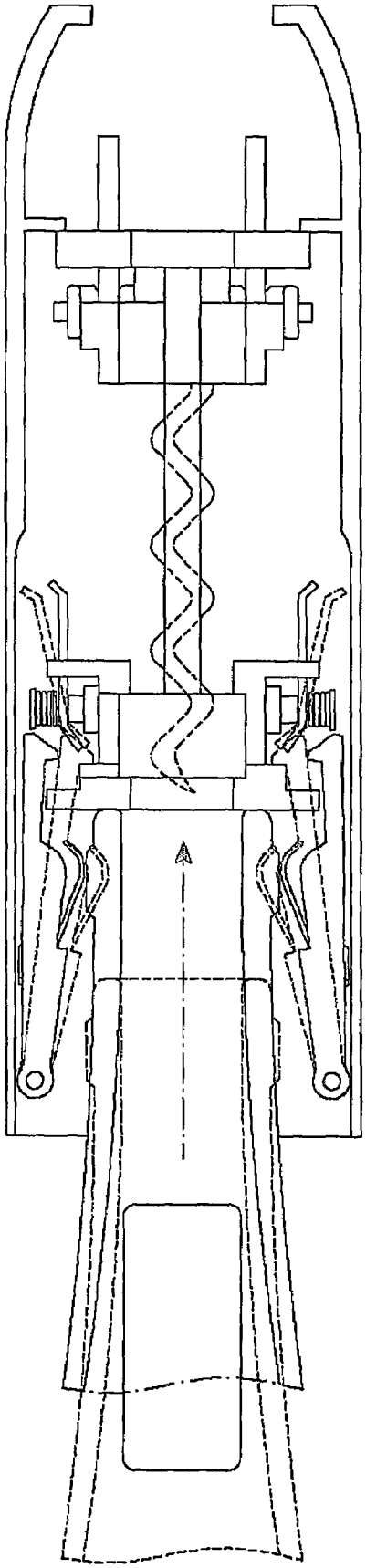
Figure 9D:
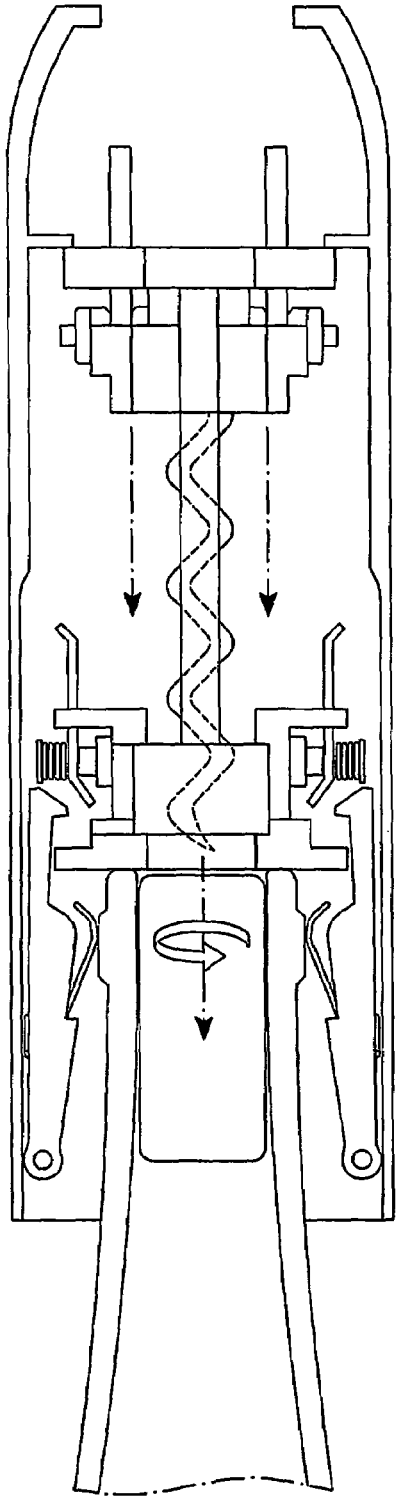

In FIGS. 3 and 9*c* the neck of a bottle 1 is inserted into the socket. The hand grips 27 are then squeezed so that the pads 29 engage the neck holding the bottle securely. FIG. 3*a* illustrates the outward displacement of the first latches by contact between the bottle neck and resilient members 9. The hooks 15 are disengaged from the guide member, freeing the latter for upward movement. Disengagement of the first latch members releases the second latch members allowing them to be urged by the springs 11 into a position where they rest on the shoulders 18 of pins 10. This is shown in FIG. 9*d*.

The handle 24 is then moved downwardly causing the rotating spiral screw to penetrate the cork. When the carriage 22 reaches its lowest position, it contacts the guide member 7. The studs 14 slide down the inner surface of the second latch plates 13 deflecting the latch plates outwardly against the restoring force of springs 11. When the stud is received into and engaged within the aperture in the latch member, the guide member and carriage are then locked together so that both move upwardly as the handle is raised. This draws the cork 30 from the bottle without rotation of the worm spiral.

Figure 9E:
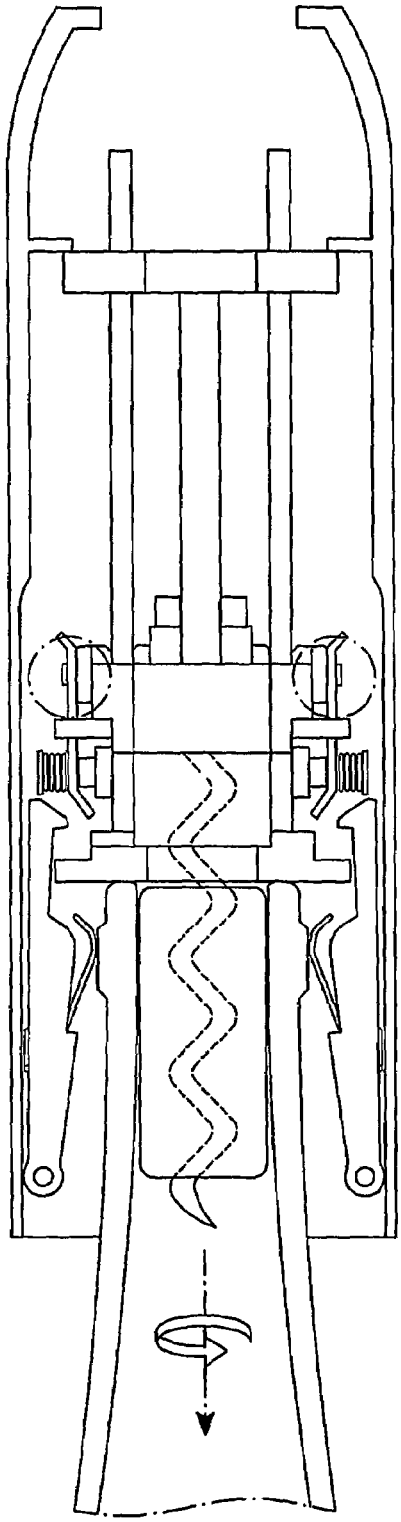
Figure 9F:
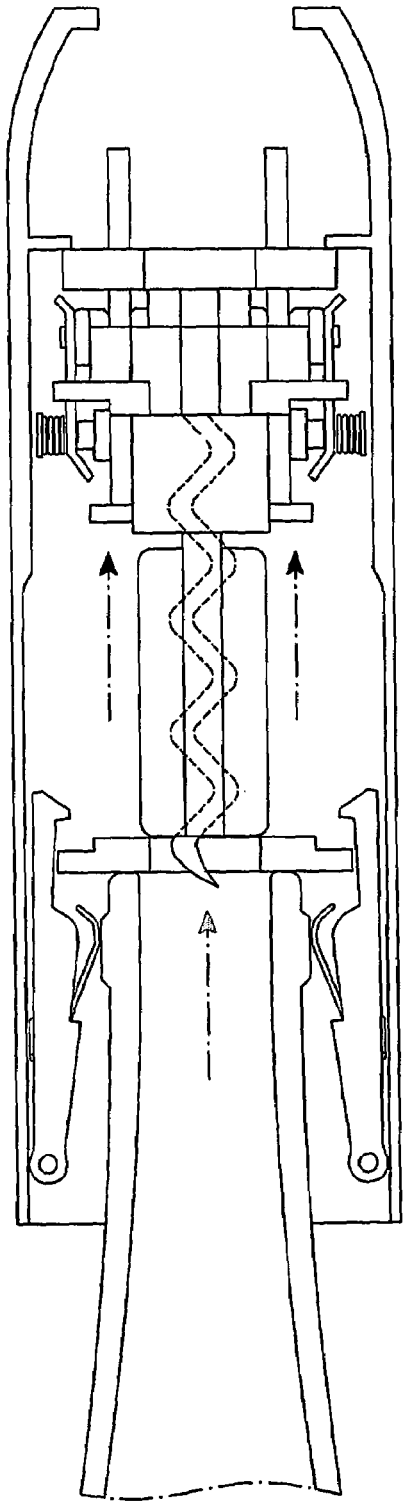
Figure 9G:
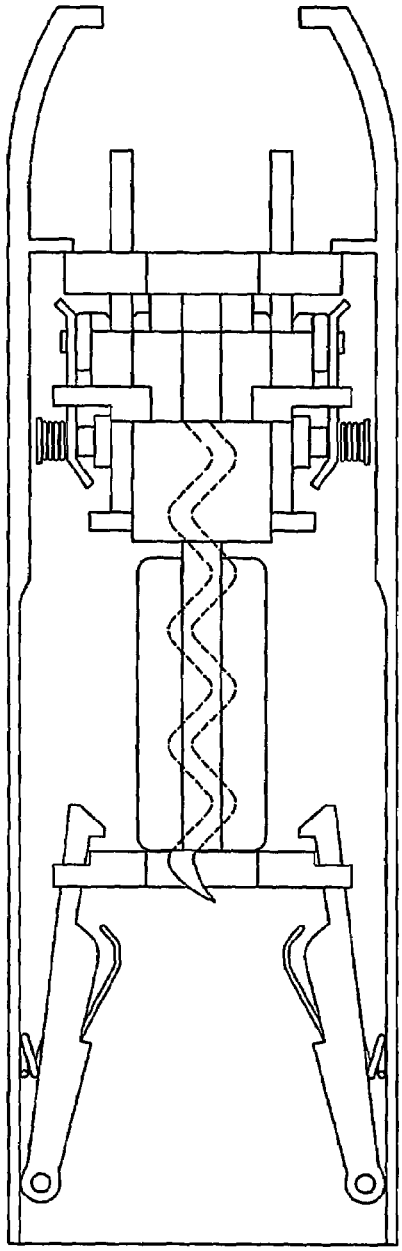
Figure 9H:
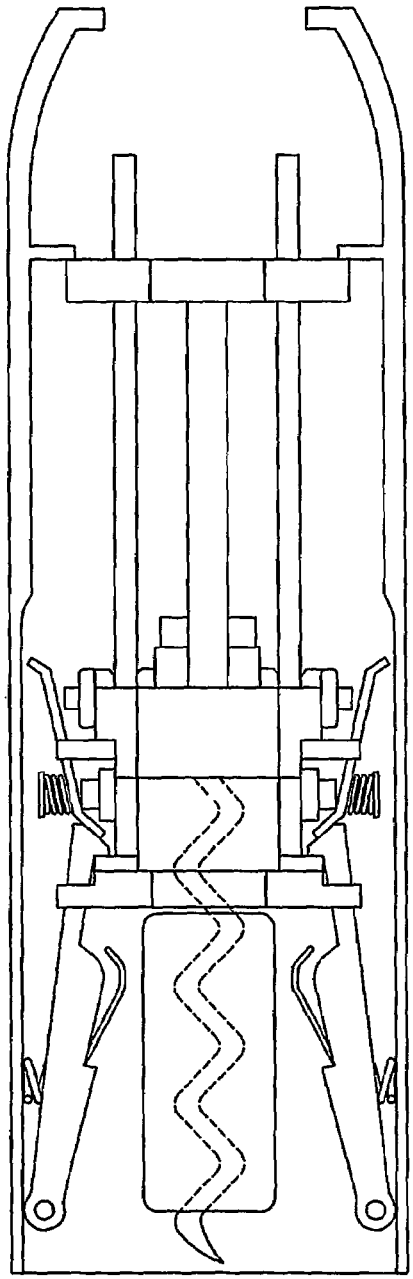

As the cork 30 is withdrawn it passes through the annulus of the annular ring 5 into a cork-receiving passageway in the upper portion of the corkscrew body as shown in FIGS. 5 and 9*e*. The grippers may then be released and the open bottle removed from the corkscrew. Removal of the bottle releases the first latches 21 as shown in FIG. 6.

Figure 9I:
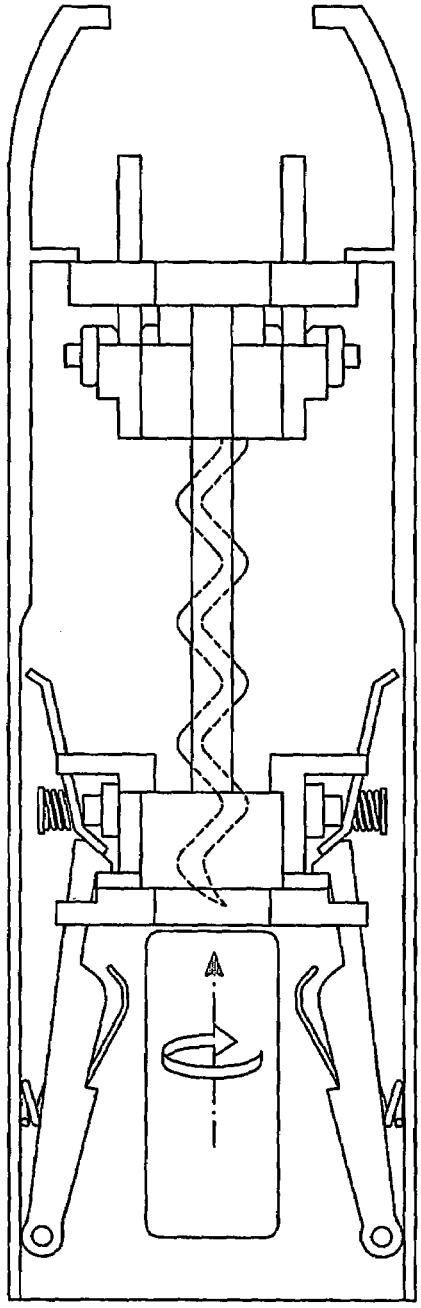

The cork is then ejected from the worm spiral by moving handle 24 downwardly to restore the latches to their initial positions, locking the guide member in the downward position and releasing the carriage. Raising of the handle causes the worm screw to be unscrewed and withdrawn from the cork as shown in FIGS. 8 and 9*i*.

The corkscrew in accordance with the present invention has a simple mode of action. A cork may be withdrawn from a bottle and discharged from the corkscrew by lowering and raising the handle twice, without need for dexterity or a great degree of physical strength by the user.

Many variations of the present invention will suggest themselves to those skilled in the art in view of the above detailed description. Such obvious variations are within the full intended scope of the appended claims.

The invention claimed is:

1. A corkscrew comprising: a body, the body including a socket adapted to receive the neck of a bottle sealed by a cork; an actuation lever; an axially rotatable worm spiral mounted on a carriage within the body and arranged to rotate and penetrate the cork as the lever is lowered, the spiral being further arranged to cease rotation as the lever is raised to withdraw the cork from the bottle, the corkscrew being further arranged to discharge the cork from the spiral by lowering and raising the lever after the neck of the bottle has been removed from the socket and wherein the carriage is mounted for movement between upper and lower positions along one or more guide runners extending longitudinally of the body, the spiral being connected to the carriage by a bearing, the spiral being rotatable with respect to the bearing; a guide member having a guideway, the spiral extending through the guideway, wherein the guideway includes a helical threaded bore adapted to receive the spiral, the guideway being adapted to cause the spiral to rotate as the spiral moves axially through the guide member; first latch means being adapted to releasably engage the guide member to the corkscrew body; and second latch means comprising an elongate plate extending from a lower flange portion, the second latch being adapted to releasably engage the guide member to the carriage.

2. The corkscrew as claimed in claim 1, wherein the first latch is actuated by insertion of the neck of the bottle into the socket.

3. The corkscrew as claimed in claim 1, wherein when the first latch is engaged, the guide member and carriage may move together to withdraw the cork from the bottle.

4. The corkscrew as claimed in claim 3, wherein when the opened bottle is removed from the socket, the first latch moves under action of a spring to an armed position, wherein the guide member is engaged and prevented from further movement when it is moved to the lower position.

5. The corkscrew as claimed in claim 1, wherein the second latch means is actuated by the first latch means.

6. The corkscrew as claimed in claim 5, wherein when the first latch means is in an armed position, the second latch means is opened.

7. The corkscrew as claimed in claim 1, wherein when the bottle has been removed from the socket, the first latch means causes the second latch means to move to an open position, wherein the carriage may move freely with respect to the guide member.

8. The corkscrew as claimed in claim 7, wherein when the bottle neck is inserted into the socket, the second latch means is urged into an armed position wherein the carriage is engaged as it moves to the lower position.

9. The corkscrew as claimed in claim 1, wherein the first latch means comprises one or more resilient members secured to the interior of the socket and biased inwardly towards the guide member.

10. The corkscrew as claimed in claim 9, wherein the first latch means includes a hook with a downwardly facing restraining surface.

11. The corkscrew as claimed in claim 1, wherein the first latch means extends from an attachment to a lower part thereof to the corkscrew body and includes an upper, downwardly facing restraining surface located to engage a complementary upwardly extending abutment surface of the guide member.

12. The corkscrew as claimed in claim 11, wherein the first latch means comprises a radially inwardly facing bottle engaging surface.

13. The corkscrew as claimed in claim 1, wherein the guide member is located on runners between the carriage and socket.

14. The corkscrew as claimed in claim 1, wherein the second latch means is elongate in the longitudinal direction.

15. The corkscrew as claimed in claim 14, wherein the second latch means is mounted on a pivot on the guide member, the upper end being urged inwardly by a spring.

16. The corkscrew as claimed in claim 14, wherein a lower portion of the second latch means is adapted to engage and cooperate with a complementary surface of the first latch means.

17. The corkscrew as claimed in claim 1, wherein the second latch means comprises a plate having an aperture adapted to receive and engage a lug extending outwardly from the carriage.

18. The corkscrew as claimed in claim 1, wherein the upper end of the socket includes an annular ring having a circular groove dimensioned to receive and engage the neck of the bottle, the annulus of the ring defining a cork receiving passageway having a diameter greater than a cork and the passageway having a length sufficient to allow complete withdrawal of the cork into the passageway as the spiral and cork are withdrawn from the bottle in use.

19. The corkscrew as claimed in claim 1, further comprising gripping means adapted to move inwardly when grasped by a user to engage and prevent movement of the neck of the bottle received in the socket.

20. The corkscrew as claimed in claim 19, wherein the gripping means comprise a pair of arms pivotally mounted on the body.

21. The corkscrew as claimed in claim 20, wherein the gripping means carry bottle engaging pads.

* * * * *